US011027560B2

(12) United States Patent
Shields

(10) Patent No.: US 11,027,560 B2
(45) Date of Patent: Jun. 8, 2021

(54) PRINTING SYSTEMS

(71) Applicant: Hewlett-Packard Development Company, L.P., Spring, TX (US)

(72) Inventor: Jay Shields, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 17 days.

(21) Appl. No.: 16/334,618

(22) PCT Filed: Jan. 27, 2017

(86) PCT No.: PCT/US2017/015304
§ 371 (c)(1),
(2) Date: Mar. 19, 2019

(87) PCT Pub. No.: WO2018/140030
PCT Pub. Date: Aug. 2, 2018

(65) Prior Publication Data
US 2020/0247141 A1 Aug. 6, 2020

(51) Int. Cl.
*B41J 11/00* (2006.01)
*B41M 5/00* (2006.01)
*B41M 7/00* (2006.01)

(52) U.S. Cl.
CPC ..... *B41J 11/002* (2013.01); *B41M 5/0047* (2013.01); *B41M 7/0081* (2013.01)

(58) Field of Classification Search
CPC .. B41J 11/0015; B41J 11/002; B41M 5/0047; B41M 7/0081
See application file for complete search history.

(56) References Cited

U.S. PATENT DOCUMENTS

| | | | | |
|---|---|---|---|---|
| 7,794,075 | B2 | 9/2010 | Nakano et al. | |
| 2006/0237153 | A1 | 10/2006 | Ochi et al. | |
| 2008/0012887 | A1 | 1/2008 | Maeno et al. | |
| 2012/0281048 | A1* | 11/2012 | Hakkaku | B41J 11/002 347/101 |
| 2013/0222500 | A1* | 8/2013 | Chiwata | B41J 11/002 347/102 |

FOREIGN PATENT DOCUMENTS

| | | |
|---|---|---|
| EP | 1849603 | 3/2011 |
| EP | 1870247 | 1/2014 |
| WO | 2010066638 | 6/2010 |
| WO | 2013167214 | 11/2013 |

OTHER PUBLICATIONS

Surface Cleaning and -Activation, IOT GmbH Impressum Sitemap, 2013, http://www.iot-gmbh.de/en/uv-systems/excimer/applications/surface-cleaning-and-activation.
International Search Report dated Sep. 14, 2017 for PCT/US2017/015304, Applicant Hewlett-Packard Development Company, L.P.

* cited by examiner

*Primary Examiner* — Justin Seo
(74) *Attorney, Agent, or Firm* — Thorpe North & Western LLP

(57) ABSTRACT

The present disclosure is drawn to printing systems. In one example, a printing system can include a first excimer irradiation source positioned to irradiate a media substrate. Additionally, an inkjet print head can be positioned with respect to the excimer irradiation source to form a printed image on the media substrate after irradiation with the excimer irradiation source.

14 Claims, 3 Drawing Sheets

PRINTING SYSTEMS

BACKGROUND

Inkjet printing has become a popular way of recording images on various media. Some of the reasons include low printer noise, variable content recording, capability of high speed recording, and multi-color recording. These advantages can be obtained at a relatively low price to consumers. As the popularity of inkjet printing increases, the types of use also increase, providing a demand for improved inkjet ink printing systems.

DETAILED DESCRIPTION

Figure 1A:
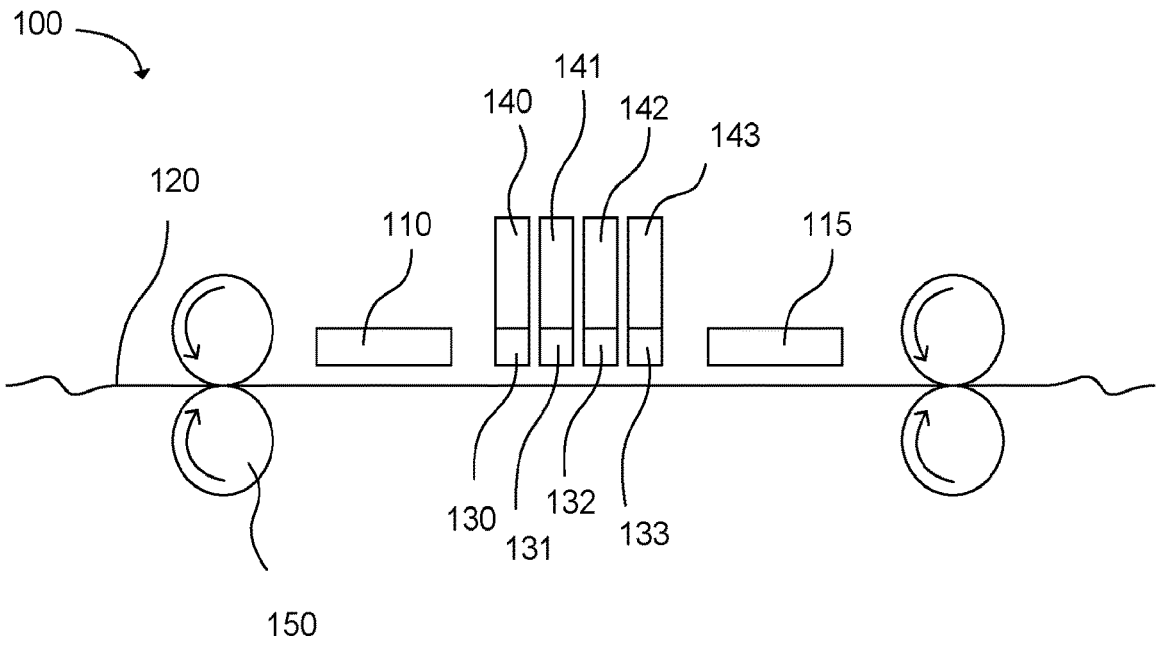
FIG. 1A is a schematic side view of an example printing system in accordance with examples of the present disclosure.

A challenge often encountered with inkjet printing is obtaining high color saturation and optical density of images printed with the ink. When the ink is printed on plain paper, the liquid vehicle can be absorbed into the paper. The colorant can thus be transported with the liquid vehicle into the paper. Because a portion of the colorant is absorbed below the surface of the paper, the printed image may appear washed out, having a low color saturation or optical density. Other problems encountered when printing inkjet inks on plain paper include strike through (e.g., the ink may be visible on the non-printed side of the paper), poor edge quality, mottling, and inter-color bleeding. Improving image quality can occur by reducing the negative visual impact of one or more of these problems.

The present disclosure is drawn to printing systems employing an excimer or other irradiation source to irradiate a portion of a media substrate before printing. The present disclosure also includes methods of forming printed images incorporating treatment of the media substrate with electromagnetic radiation from the excimer irradiation source and printed articles made using such methods.

A printing system according to an example of the present disclosure can include a first excimer irradiation source positioned to irradiate a media substrate. An inkjet print head can be positioned with respect to the excimer irradiation source to form a printed image on the media substrate after irradiation with the excimer irradiation source. Pre-treatment with electromagnetic radiation from an excimer irradiation source can modify the surface of the media substrate so that the surface interacts with inkjet ink printed on the surface to improve print quality. In one example, pre-treatment of plain paper with electromagnetic radiation from an excimer irradiation source, even without the use of fixer present (e.g., a digitally printed fixer or an analog fixer coating, or ColorLok® paper), can provide a paper substrate that can meet or exceed the print quality achieved using paper with a fixer. For example, the print quality on a plain paper, after pre-treatment with electromagnetic radiation from the excimer irradiation source, can approach, match, or exceed the print quality provided using ColorLok® paper or paper that has a fixative solution applied before printing.

A variety of excimer irradiation sources can be used, such as an excimer lamp, or the like, such as those available from Ushio America, Inc, Osram, Hamamatsu, and Heraeus, for example. The principle of operation of excimer irradiation sources is generally known in the art. Briefly, an excimer is a dimeric or heterodimeric molecule formed of two species, where typically one or both of the species have a filled valence shell. Formation of a dimeric or heterodimeric molecule that includes a species having a filled valence shell (e.g. a nobel gas) is typically only possible in an excited state and for a short period of time. When an excited dimer (excimer) or excited complex (exciplex) molecule de-excites to its ground state it releases its excitation energy as a photon, such as an ultraviolet photon. It is noted that excimer and exciplex molecules and/or irradiation sources are generally referred to herein as excimer molecules and/or excimer irradiation sources. Thus, any reference to an excimer molecule and/or excimer irradiation source is also intended to encompass an exciplex molecule and/or exciplex irradiation source unless otherwise specified.

The emission spectrum of an excimer irradiation source can typically be characterized by an intense narrow emission band. Depending on the excimer molecule used in the excimer irradiation source, the band width at full-width and half maximum can typically be from about 1.5 nanometers (nm) to about 15 nm. As such, excimer irradiation sources can provide quasimonochromatic electromagnetic radiation.

The first excimer irradiation source can typically emit electromagnetic radiation at a wavelength in a range that is adequate to break apart molecular oxygen. In some specific examples, the first excimer irradiation source can emit electromagnetic radiation at a wavelength of from about 100 nm to about 240 nm. In yet other examples, the excimer irradiation source can emit electromagnetic radiation at a wavelength of from about 108 nm to about 175 nm, from about 165 nm to about 190 nm, or from about 172 nm to about 222 nm.

A variety of excimer molecules can be used in the first excimer irradiation source to generate an appropriate wavelength of electromagnetic radiation. Typically, any suitable excimer molecule that can emit electromagnetic radiation at a wavelength that is adequate to break apart molecular oxygen (e.g. a wavelength of 225 nm or below) can be used. Non-limiting examples of excimer molecules can include NeF, $Ar_2$, $Kr_2$, $F_2$, ArBr, $Xe_2$, ArCl, KrI, ArF, KrBr, KrCl, the like, or combinations thereof.

The first excimer irradiation source can typically be positioned at a distance from the media substrate of from about 0.5 millimeters (mm) to about 5 mm. In yet other examples, the first excimer irradiation source can be positioned at a distance of from about 1 mm to about 4 mm from the media substrate. However, in some examples, the first excimer irradiation source can be positioned at distances from the media substrate other than those described above. In some examples, the first excimer irradiation source can be fixed at a particular distance from the media substrate. In yet other examples, the first excimer irradiation source can be movable to a particular distance or range of distances from the media substrate.

In some examples, the placement of the first excimer irradiation source can depend on the surface power density of the first excimer irradiation source. For example, in some cases, where the surface power density is relatively high, the first excimer irradiation can be positioned at a greater distance from the media substrate, and vice versa. In some specific examples, the first excimer irradiation source can have a surface power density ranging from 50 milliwatts per square centimeter ($mW/cm^2$) to 100 $mW/cm^2$ at the surface of the excimer irradiation source. In yet other examples, the excimer irradiation source can have a surface power density ranging from 40 $mW/cm^2$ to 90 $mW/cm^2$ at the excimer irradiation source.

In some examples, the lamp can have sufficient power metrics and can be positioned at a distance from the media substrate to provide electromagnetic radiation at the surface of the media substrate at a surface power density of from 20 $mW/cm^2$ to 80 $mW/cm^2$. In yet other examples, the excimer irradiation source can provide electromagnetic radiation at the surface of the media substrate at a surface power density of from 15 $mW/cm^2$ to 65 $mW/cm^2$.

In some examples, the first excimer irradiation source can modify the surface of the media substrate so that the surface has improved interactions with inkjet ink. Without being bound to a particular mechanism, the treatment with electromagnetic radiation from the first excimer irradiation source can produce highly oxidizing species such as atomic oxygen and OH radicals. These species can react with components in the media substrate to form oxygen-containing groups such as —OH groups, acid groups, and carbonyl groups.

It is noted that many types of paper contain calcium carbonate, which is added when the paper is manufactured. Treatment with electromagnetic irradiation from the first excimer irradiation source can in some cases convert some of the calcium carbonate into calcium ions. Thus, in some examples, $Ca^{2+}$ ions can be liberated from their insoluble and unavailable form as calcium carbonate to act as a fixer for colorant applied to the paper.

In some additional examples, the printing system can include a second excimer irradiation source positioned to treat the printed image after application to the media substrate. The second excimer irradiation source can be positioned at the same distances from the media substrate as listed above with respect to the first excimer irradiation source and can be fixed at a particular position or movable within a particular range of positions. Further the second excimer irradiation source can have the same surface power density at the surface of the excimer irradiation source and can provide the same surface power density at the surface of the media substrate as listed above with respect to the first excimer irradiation source.

In some examples, the second excimer irradiation source can also emit electromagnetic radiation within the same wavelength range as listed above for the first excimer irradiation source. In some specific examples, the second excimer irradiation source can emit electromagnetic radiation at the same wavelength as the first excimer irradiation source. In yet other examples, the second excimer irradiation source can emit electromagnetic radiation at a different wavelength than the first excimer irradiation source. In further examples, the second excimer irradiation source can emit electromagnetic radiation outside of the range listed above with respect to the first excimer irradiation source. More specifically, the second excimer irradiation source can, in some examples, emit electromagnetic radiation at a wavelength of from about 108 nm to about 351 nm.

As described above, the second excimer irradiation source can be used to treat the printed image. In some examples, the inkjet ink can include a curable component, such as a binder, which can be cured by exposure to electromagnetic radiation from the second excimer irradiation source. For example, a curable binder can include monomers, oligomers, or polymers that polymerize or crosslink upon exposure to free radicals. The second excimer irradiation source can facilitate the generation of free radicals, which can interact with the curable binder to begin the polymerization or crosslinking process. In other examples, the second excimer irradiation source can be used in conjunction with a polymerizable overcoat composition that can polymerize on the printed image and form a protective overcoat over the image. The second excimer irradiation source can also be used to perform a variety of additional post-treatments to the printed image, as will be recognized by those skilled in the art.

With this description in mind, FIG. 1A shows a schematic side view of a printing system 100 in accordance with examples of the present disclosure. The printing system can include a first excimer irradiation source 110 that can be proximate to a media substrate 120. The first excimer irradiation source can be positioned to expose the media substrate to electromagnetic radiation emitted from the first excimer irradiation source. The printing system can also include inkjet print heads 130, 131, 132, 133. The inkjet print heads are positioned with respect to the first excimer irradiation source to form a printed image on the media substrate after treatment with electromagnetic radiation emitted from the first excimer irradiation source. The inkjet print heads can be used to print different colors, such as cyan, magenta, yellow, black, blue, green, red, purple, orange, gray, etc., or a clear overcoat. In certain examples, the colors may be cyan, magenta, and yellow (three colors); or cyan, magenta, yellow, and black (four colors). The inkjet print heads may also be in fluid communication with ink reservoirs 140, 141, 142, 143, and may carry the inks. The media substrate, as shown, can be conveyed past the first excimer irradiation source and the inkjet print heads by conveyors 150. Optionally, a second excimer irradiation source 115 can be positioned to treat the printed image after the image has been applied to the media substrate.

Figure 1B:
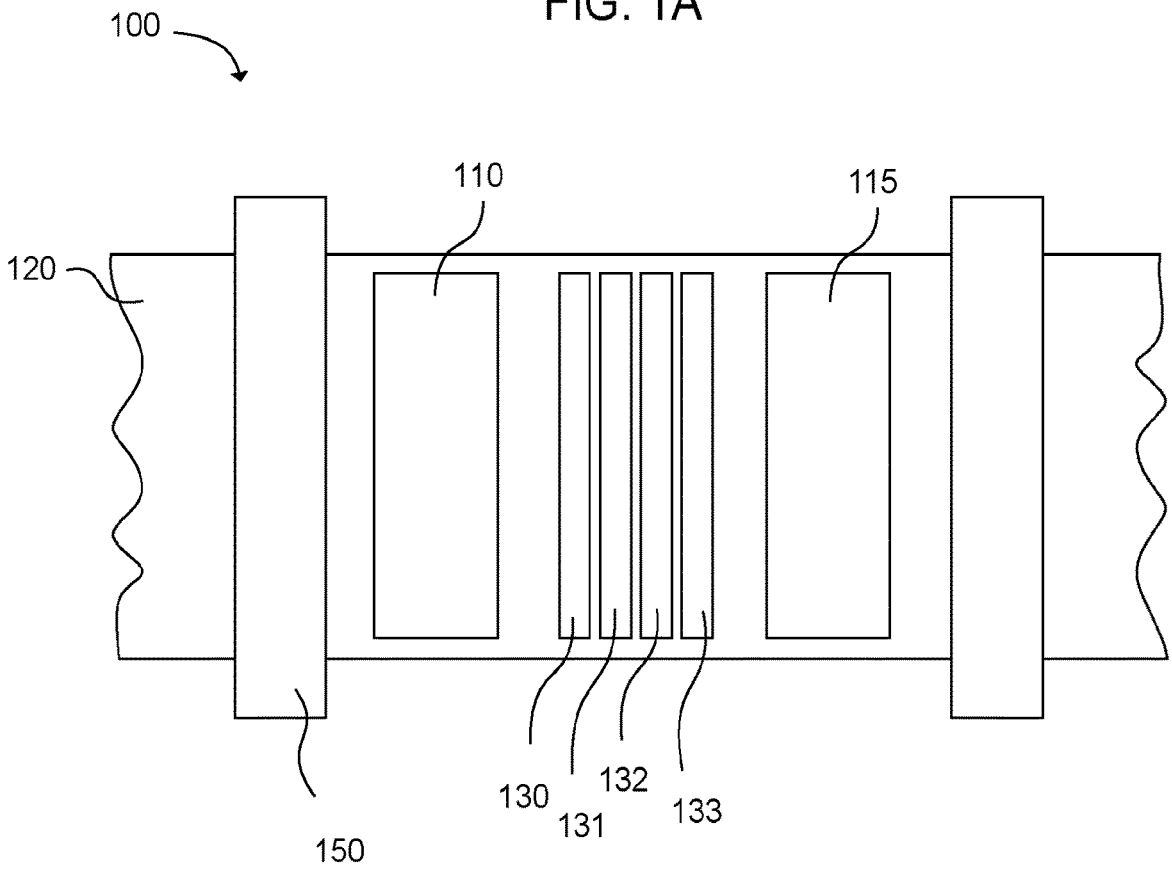
FIG. 1B is a schematic top view of an example printing system in accordance with examples of the present disclosure.

FIG. 1B shows a schematic top view of the printing system of FIG. 1A. As shown in FIG. 1B, in some examples, the first excimer irradiation source 110 and inkjet print heads 130, 131, 132, 133 can have nearly the same width as the media substrate 120. In certain examples, the first excimer irradiation source can be 75% or more as wide as the media substrate, or 90% or more as wide as the media substrate. In further examples, the first excimer irradiation source can be as wide as the media substrate or wider. Additionally, the printing system can optionally include a second excimer irradiation source 115 positioned to treat the printed image after the image has been applied to the media substrate. In some examples, the second excimer irradiation source can also be 75% or more as wide as the media substrate, 90% or more as wide as the media substrate, as wide as the media substrate, or wider.

In some examples, the first excimer irradiation source 110, the optional second excimer irradiation source 115, and/or the inkjet print heads 130, 131, 132, 133 can be held stationary while the media substrate is conveyed past. Thus, in one example, the first excimer irradiation source can treat the entire width of the media substrate or a portion of the media substrate as wide as the first excimer irradiation source. After the media substrate is treated, the inkjet print heads can print ink onto the media substrate as the media substrate is conveyed past. Optionally, the second excimer irradiation source can post-treat the entire width of the media substrate or a portion of the media substrate as wide as the second excimer irradiation source.

In other examples, first excimer irradiation source 110, the optional second excimer irradiation source 115, and/or the inkjet printheads 130, 131, 132, 133 can be movable on a carriage and traverse the media substrate. In other words, in the example shown, these features are static, but one or more can alternatively be movable.

The treatment with electromagnetic radiation emitted from the first excimer irradiation source can effectively modify the surface of the media substrate very quickly so that distance between the first excimer irradiation source and the inkjet print heads is not particularly limiting, e.g., many different distances can be used. Additionally, the treatment can retain its effect on the surface of the media substrate for an extended time, such as more than one month or more than one year. Thus, no particular proximity of distance or time between use of the first excimer irradiation source and the inks impact the result. However, in some examples, the first excimer irradiation source can be positioned directly adjacent to the inkjet print heads. In other examples, the first excimer irradiation source can be positioned any convenient distance from the inkjet print heads, such as from 1 mm to 10 meters away from the inkjet print heads. This can provide advantages over printing systems that apply a liquid fixer solution to a media substrate before printing, because such systems often employ a drying zone between the fixer application and the print heads. Such systems can use a drying oven or a long distance between the fixer application and the print heads to allow water and/or other solvents in the fixer solution to evaporate. In some cases, such printing systems run at a slower printing speed to give the fixer solution more time to dry. In contrast, the treatment used in the present technology can be a dry treatment. Therefore, in many examples, no liquid is added to the media substrate and no drying zone is used between the first excimer irradiation source and the inkjet print heads.

The distance between the inkjet print heads and the optional second excimer irradiation source can be sufficient to allow the printed image to partially or fully dry before the image is treated. In some examples, a curable inkjet ink can produce a stronger cure when the ink has been allowed to dry. However, other inks may produce a stronger cure if they are cured when still wet. Thus, the position of the second excimer irradiation source can be selected based on the characteristics of the ink being employed. In further examples, the printing system can include a dryer or drying zone between the inkjet print heads and the second excimer irradiation source. The dryer or drying zone can dry the ink making up the printed image more quickly. For example, a dryer can include a heater to heat the printed image to evaporate water and/or volatile solvents in the ink.

Figure 2:
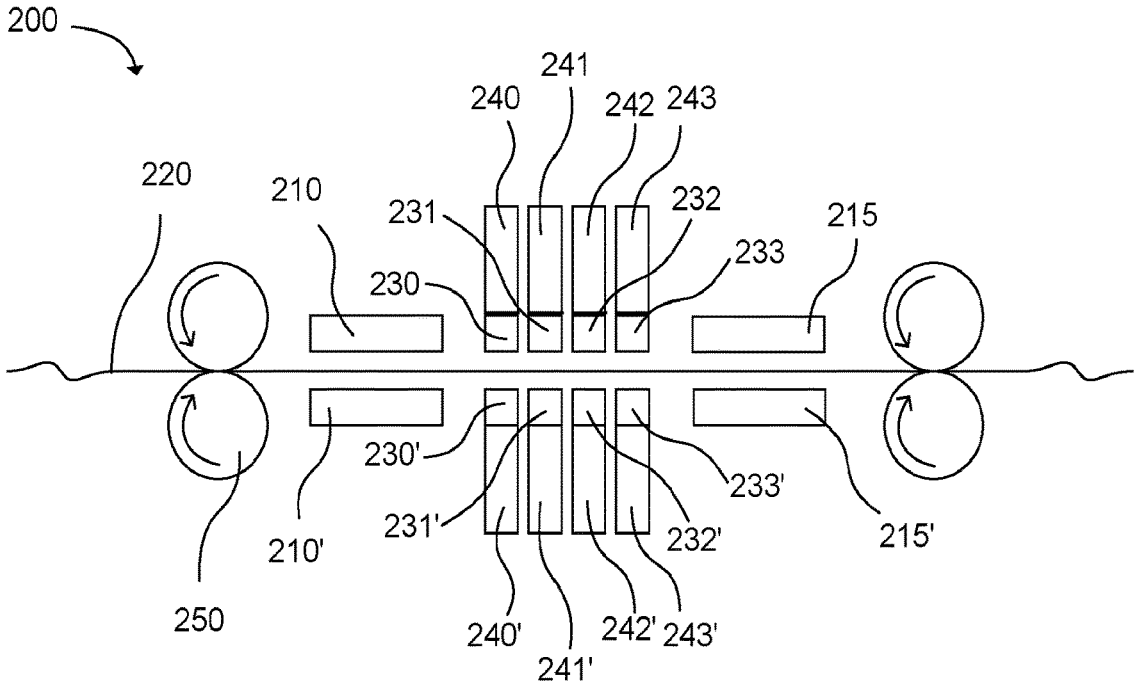
FIG. 2 is a schematic side view of an example printing system in accordance with examples of the present disclosure.

It should be noted that the example shown in FIGS. 1A and 1B is only a single example of the presently disclosed technology. In other examples, printing systems according to the present disclosure can have a variety of different configurations. FIG. 2 shows another example of a printing system 200 that includes a first excimer irradiation source 210 and inkjet print heads 230, 231, 232, 233 in fluid communication with ink reservoirs 240, 241, 242, 243. These components are positioned to pretreat and print on a first surface of the media substrate 220. Another first excimer irradiation source 210' and inkjet print heads 230', 231', 232', 233' in fluid communication with ink reservoirs 240', 241', 242', 243' are positioned on an opposite side of the media substrate to pretreat and print the opposite surface of the media substrate. The media substrate is conveyed between the two sets of first excimer irradiation sources and inkjet print heads by conveyors 250. Thus, the system can pretreat and print on both surfaces of the media substrate simultaneously. Optional second excimer irradiation sources 215 and 215' can also be positioned with respect to the inkjet print heads to post-treat printed images on both surfaces of the media substrate simultaneously.

In other examples, the first excimer irradiation source, optional second excimer irradiation source, and/or the inkjet print head can be movable with respect to the media substrate. For example, in a web fed printing system the first excimer irradiation source, optional second excimer irradiation source, and/or inkjet print head can move in a direction perpendicular to the movement direction of the media web. In another example, the printing system can be sheet fed. A media substrate sheet can be fed by conveyors past the first excimer irradiation source, optional second excimer irradiation source, and inkjet print head, while the first excimer irradiation source, optional second excimer irradiation source, and/or inkjet print head can move in a direction perpendicular to the movement direction of the media sheet. In a further example, the printing system can have a static printing bed on which a media substrate sheet is placed. The first excimer irradiation source, optional second excimer irradiation source, and/or the inkjet print head can move in two dimensions (i.e., the x-axis and y-axis directions) over the media substrate sheet to pretreat, print on the media substrate sheet, and/or post-treat the printed image.

Figure 3:
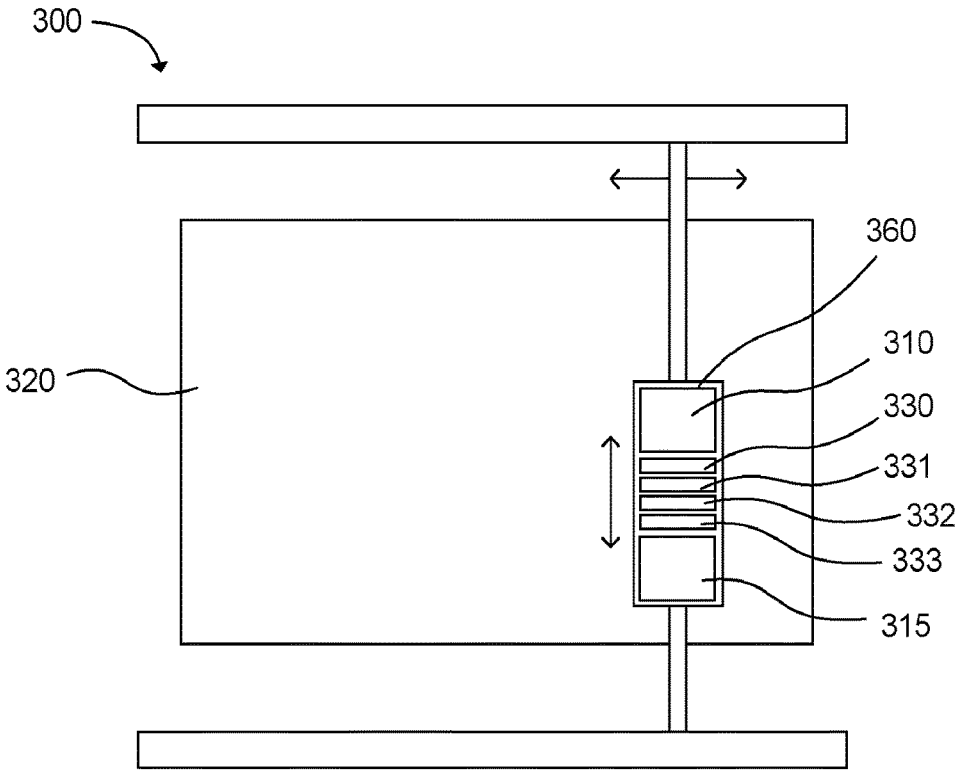
FIG. 3 is a schematic top view of an example printing system in accordance with examples of the present disclosure.

FIG. 3 shows an example of a printing system 300 including a stationary media substrate sheet 320. In this system, a first excimer irradiation source 310, optional second excimer irradiation source 315, and inkjet print heads 330, 331, 332, 333 are located together on a carriage 360. The carriage is moveable in the x-axis and y-axis directions so that the first excimer irradiation source can pretreat portions of the media substrate sheet, after which the inkjet print heads can print on the pretreated portions. Where the second excimer irradiation source is included, it can also be included on the carriage to post-treat the printed image after it has been applied to the media substrate. Further, in one example, the media substrate may also or alternatively be movable. For example, the carriage may move in the y-axis as shown while the media substrate is moved along the x-axis.

As mentioned above, the printing systems described herein can include an inkjet print head. In some examples, a printing system can include a single inkjet print head. The inkjet print head can be in fluid communication with a reservoir of black ink or a colored ink. In other examples, the printing system can include multiple inkjet print heads. For example, the printing system can include an inkjet print head for several different colors, such as cyan, magenta, yellow, and black. In further examples, other colors of ink or clear overcoat material can be included.

As used herein, "inkjetting" or "jetting" refers to ejecting compositions from jetting architecture, such as inkjet architecture. Inkjet architecture can include thermal, piezo, or continuous inkjet architecture. A thermal inkjet print head can include a resistor that is heated by electric current. Inkjet ink can enter a firing chamber and the resistor can heat the ink sufficiently to form a bubble in the ink. The expansion of the bubble can cause a drop of ink to be ejected from a nozzle connected to the firing chamber. Piezo inkjet print heads are similar, except that instead of a thermal resistor, a piezoelectric element is used to mechanically force a drop of ink out of a nozzle. In a continuous inkjet printing system, a continuous stream of ink droplets is formed and some of the droplets can be selectively deflected by an electrostatic field onto the media substrate. The remaining droplets may be recirculated through the system. Inkjet print heads can be configured to print varying drop sizes such as less than 10 picoliters, less than 20 picoliters, less than 30 picoliters, less than 40 picoliters, less than 50 picoliters, etc.

In some cases, the ink used in the printing systems described herein can be a water-based inkjet ink or a solvent-based inkjet ink. Inkjet inks generally include a colorant dispersed or dissolved in an ink vehicle. As used herein, "liquid vehicle" or "ink vehicle" refers to the liquid fluid in which a colorant is placed to form an ink. A wide variety of ink vehicles may be used with the methods of the present disclosure. Such ink vehicles may include a mixture of a variety of different agents, including, surfactants, solvents, co-solvents, anti-kogation agents, buffers, biocides, sequestering agents, viscosity modifiers, surface-active agents, water, etc.

Generally the colorant discussed herein can include a pigment and/or dye. As used herein, "dye" refers to compounds or molecules that impart color to an ink vehicle. As such, dye includes molecules and compounds that absorb electromagnetic radiation or certain wavelengths thereof. For example, dyes include those that fluoresce and those that absorb certain wavelengths of visible light. In most instances, dyes are water soluble. However, in some examples, the dye can be water insoluble and dispersed in an aqueous medium. Furthermore, as used herein, "pigment" generally includes pigment colorants, magnetic particles, aluminas, silicas, and/or other ceramics, organo-metallics or other opaque particles. In one example, the colorant can be a pigment. In a further example, the colorant can be an anionic pigment material that can interact with cationic species, acid groups, and/or oxygen containing groups at the surface of the media substrate that has been treated with the first excimer irradiation source as described herein. For instance, the anionic pigment material can include an anionic dispersant (e.g. molecule, oligomer, polymer) that is adsorbed to or covalently bonded to the pigment and that is sensitive to multivalent cations such as $Ca^{2+}$, sensitive to reductions in pH, or both. In some specific examples, the anionic dispersant can include carboxylate or phosphonate functionalities.

In certain examples, the colorant can be a pigment having a dispersing group covalently bonded to surfaces of the pigment. The dispersing groups can be, for example, small groups, oligomeric groups, polymeric groups, or combinations thereof. In other examples, the pigment can be dispersed with a separate dispersant. Suitable pigments include, but are not limited to, the following pigments available from BASF: Paliogen® Orange, Heliogen® Blue L 6901F, Heliogen® Blue NBD 7010, Heliogen® Blue K 7090, Heliogen® Blue L 7101F, Paliogen® Blue L 6470, Heliogen® Green K 8683, and Heliogen® Green L 9140. The following black pigments are available from Cabot: Monarch® 1400, Monarch® 1300, Monarch® 1100, Monarch® 1000, Monarch® 900, Monarch® 880, Monarch® 800, and Monarch® 700. The following pigments are available from CIBA: Chromophtal® Yellow 3G, Chromophtal® Yellow GR, Chromophtal® Yellow 8G, Igrazin® Yellow 5GT, Igralite® Rubine 4BL, Monastral® Magenta, Monastral® Scarlet, Monastral® Violet R, Monastral® Red B, and Monastral® Violet Maroon B. The following pigments are available from Degussa: Printex® U, Printex® V, Printex® 140U, Printex® 140V, Color Black FW 200, Color Black FW 2, Color Black FW 2V, Color Black FW 1, Color Black FW 18, Color Black S 160, Color Black S 170, Special Black 6, Special Black 5, Special Black 4A, and Special Black 4. The following pigment is available from DuPont: Tipure® R-101. The following pigments are available from Heubach: Dalamar® Yellow YT-858-D and Heucophthal Blue G XBT-583D. The following pigments are available from Clariant: Permanent Yellow GR, Permanent Yellow G, Permanent Yellow DHG, Permanent Yellow NCG-71, Permanent Yellow GG, Hansa Yellow RA, Hansa Brilliant Yellow 5GX-02, Hansa Yellow-X, Novoperm® Yellow HR, Novoperm® Yellow FGL, Hansa Brilliant Yellow 10GX, Permanent Yellow G3R-01, Hostaperm® Yellow H4G, Hostaperm® Yellow H3G, Hostaperm® Orange GR, Hostaperm® Scarlet GO, and Permanent Rubine F6B. The following pigments are available from Mobay: Quindo® Magenta, Indofast® Brilliant Scarlet, Quindo® Red R6700, Quindo® Red R6713, and Indofast® Violet. The following pigments are available from Sun Chemical: L74-1357 Yellow, L75-1331 Yellow, and L75-2577 Yellow. The following pigments are available from Columbian: Raven® 7000, Raven® 5750, Raven® 5250, Raven® 5000, and Raven® 3500. The following pigment is available from Sun Chemical: LHD9303 Black. Any other pigment and/or dye can be used that is useful in modifying the color of the ink. Additionally, the colorant can include a white pigment such as titanium dioxide, or other inorganic pigments such as zinc oxide and iron oxide.

In further examples, the ink can include a binder. In some examples, the binder can be a latex polymer. In further examples, the binder can include polymers, copolymers, or combinations thereof. The polymers and copolymers can be formed of styrene, acrylic acid, methacrylic acid, methyl methacrylate, butyl acrylate, divinylbenzene, or combinations thereof. In another example, the binder can be a polyurethane binder.

In some cases the binder can be curable. That is, the binder can be further polymerized or cross-linked after the ink is printed onto the media substrate. In one such example, the binder can include a polymerizable polyurethane. The polymerizable polyurethane can be included in the ink in an amount from 1 wt % to 20 wt % in some examples. In further examples, the polymerizable polyurethane can be water dispersible and the ink can include an aqueous vehicle.

In certain examples, the polymerizable polyurethane binder can be formed from the following components: (a) a diisocyanate (b) a polyol, (c) an acrylate or methacrylate with two or more hydroxyl functional groups, (d) a compound including an ionic group or a group capable of forming an ionic group, and (e) another acrylate or methacrylate, the other acrylate or methacrylate having a hydroxyl functional group or an amino functional group. These components can be selected so that the resulting curable polyurethane binder has a weight average molecular weight (Mw) equal to or less than 5,000, a glass transition temperature (Tg) less than 25° C., a double bond density higher than 1.0, and an acid number ranging from 5 to 30.

In addition, the curable polyurethane binder disclosed herein may have a ratio of isocyanate groups (NCO) to hydroxyl groups (OH) (i.e., NCO:OH ratio) that is greater than 1.8. In another example, the NCO:OH ratio of the curable polyurethane binder is equal to or greater than 2.1. In yet another example, the NCO:OH ratio ranges from about 2.6 to about 2.8. In this NCO:OH ratio, it is to be understood that the number of hydroxyl groups (OH) making up the OH portion of the ratio is not the total number of hydroxyl groups in the polyurethane binder, but rather is determined from the hydroxyl groups of component (b) (polyol), component (c) (acrylate or methacrylate with two or more hydroxyl functional groups), and component (d) (the compound including an ionic group or a group to form an ionic group). As such, the total number of OH groups for the NCO:OH ratio is not based on hydroxyl groups from component (e). While not accounted for in this NCO:OH ratio, it is to be understood that the total number of hydroxyl groups (OH) in the polyurethane binder also includes any hydroxyl groups from component (e).

For component (a), any non-aromatic diisocyanate may be used. In an example, the non-aromatic diisocyanate may be hexamethylene-1,6-(HDI), 2,2,4-trimethyl-hexamethylene-diisocyanate, or a combination thereof. The polyurethane can exclude any other isocyanate. The amount of the non-aromatic diisocyanate within the curable binder dispersion can range from about 20 wt % to about 50 wt % of the total weight of the curable polyurethane. In an example, hexamethylene diisocyanate can make up from about 30 wt % to about 50 wt % of the polyurethane binder.

Turning to component (b), the amount of component (b) (i.e., the polyol) within the curable polyurethane binder dispersion can range from about 10 wt % to about 30 wt % of the total weight of the curable polyurethane. In an example, component (b) (i.e., the polyol) can make up from about 15 wt % to about 25 wt % of the polyurethane binder.

Component (b) can be a polyol. The term "polyol", as used herein, means any product having an average of about 2 or more hydroxyl groups per molecule. Some examples of suitable polyols for component (b) may be part of a first class of polyols. As examples, the first class of polyols has a number average molecular weight ranging from about 500 to about 5,000. In any of these examples, component (b) can be a macro-glycol. Examples of suitable polyols of the first class include polyester polyols, polyether polyols, polycarbonate polyols, poly(ethyleneoxide) polyols, polyhydroxy polyester amides, hydroxyl-containing polycaprolactones, hydroxyl-containing acrylic polymers, hydroxyl-containing epoxides, polyhydroxy polycarbonates, polyhydroxy polyacetals, polyhydroxy polythioethers, polysiloxane polyols, ethoxylated polysiloxane polyols, polybutadiene polyols, hydrogenated polybutadiene polyols, polyisobutylene polyols, polyacrylate polyols, halogenated polyesters and polyethers, or mixtures thereof. In an example, the polyol can be poly(propyleneglycol), poly(tetrahydrofuran), poly (ethyleneoxide), a polycarbonate polyol, or a polyester polyol.

Other examples of suitable polyols for component (b) may be part of a second class of polyols. The second class has a number average molecular weight that is 500 or lower. Examples of suitable polyols of the second class include 1,2-propanediol, 1,3-propanediol, 1,2-butanediol, 1,3-butanediol, 1,4-butanediol, 1,5-pentanediol, 3-methylpentane-1,5-diol, 1,6-hexanediol, neopentylglycol, cyclohexane-1,4-dimethanol, 1,2-cyclohexanediol, 1,4-cyclohexanediol, 2-ethyl-3-propylpentanediol, 2,4-dimethylpentanediol, 2-ethyl-2-butylpropanediol, diethyleneglycol, triethyleneglycol, tetraethyleneglycol, dipropyleneglycol, tripropyleneglycol, N-substituted ethanolamines, and mixtures thereof. In an example, the polyol is selected from 1,4-butanediol, 1,5-pentanediol, 3-methylpentane-1,5-diol, 1,6-hexanediol, neopentylglycol, and cyclohexane-1,4-dimethanol, trimethylolpropane, glycerol, or pentaerythritol.

It is to be understood that a combination of any of the listed polyols may be used.

The curable polyurethane binder dispersion may further include component (c). Component (c) includes an acrylate or methacrylate with two or more hydroxyl functional groups. In this example, the acrylate or methacrylate with two or more hydroxyl functional groups is present in an amount ranging from greater than 0 wt % to about 40 wt % based on the total weight of the curable polyurethane.

Some examples of the acrylate or methacrylate with two or more hydroxyl functional groups include those obtained from the reaction of diglycidyl compounds with (meth) acrylic acid. Aliphatic diglycidyl compounds derived from alpha, omega diols having 4 to 12 carbon atoms or from polyoxyalkylenediols (such as polyethylene glycol, polypropylene glycol, or mixtures thereof that contain oxyalkylene groups) may be used. Some specific examples include 1,4-butanediol diglycidyl ether, 1,6-hexanediol diglycidyl ether, cyclohexanedimethanol diglycidyl ether, polyethylene glycol diglycidyl ether, polypropylene glycol diglycidyl ether, hydrogenated bisphenol A diglycidyl ether (BGDA or BADGE), hydrogenated bisphenol F diglycidyl ether, and their ethoxylated and/or propoxylated equivalents. An additional example is 1,6-hexanediylbis[oxy(2-hydroxy-3,1-propanediyl)] bisacrylate. Some commercially available examples include MIRAMAR™ PE-210 and MIRAMAR™ PE-230 (Miwon Chemical).

In further examples, the acrylate or methacrylate with two or more hydroxyl functional groups can include aromatic diglycidyl compounds derived from bisphenol A and bisphenol F. Specifically, bisphenol A diglycidyl ether, bisphenol F diglycidyl ether and their ethoxylated and/or propoxylated equivalents may be used. Diglycidyl esters may also be used, such as diglycidyl phthalate, N,N-diglycidyl aniline, or N,N-diglycidyl-4-glycidyloxyaniline. Some specific examples include a diacrylate ester of bisphenol A diglycidyl ether (BGDA) and a dimethacrylate ester of bisphenol A diglycidyl ether (BGDM).

Component (d) is a compound including an ionic group or a group that is capable of forming an ionic group. The amount of component (d) within the curable binder dispersion ranges from greater than 0 wt % to about 10 wt % based upon the total weight of the curable polyurethane. In an example, component (d) makes up from about 2 wt % to about 6 wt % of the polyurethane binder.

The presence of component (d) assists in the ability of the polyurethane to be dissolved or dispersed in water after ionization with a base. Examples of component (d) may be derived from hydroxy-carboxylic acids having the general formula (HO)xQ(COOH)y, where Q is a straight or branched hydrocarbon radical containing 1 to 12 carbon atoms, and x and y each independently range from 1 to 3. Examples of suitable hydroxy-carboxylic acids include dimethylol propionic acid (DMPA), dimethylol butanoic acid (DMBA), citric acid, tartaric acid, glycolic acid, lactic acid, malic acid, dihydroxymaleic acid, dihydroxytartaric acid, or mixtures thereof. Hydroxyls or amines containing a sulfonate functional group can also be used as component (d). Examples include taurine and aminoethylaminopropylsulfonate (EPS). Hydroxyls or amines containing a phosphate functional group can also be used as component (d). An example includes glycerol phosphate disodium dehydrate.

Turning now to component (e), component (e) is an acrylate or methacrylate having a hydroxyl functional group or an amino functional group. The amount of component (e) in the curable polyurethane binder dispersion can range from greater than 10 wt % to about 65 wt % based upon the total weight of the curable polyurethane. In an example, component (e) makes up from about 20 wt % to about 50 wt % of the polyurethane binder.

Some examples of component (e) include the esterification products of aliphatic and/or aromatic polyols with acrylic acid or methacrylic acid. These products have a residual OH functionality of about 1. Some of these products also have two or more acrylic functionalities. Examples of component (e) include the partial esterification products of acrylic acid or methacrylic acid with tri-, tetra-, penta- or hexahydric polyols or mixtures thereof. These modified or unmodified polyols are partly esterified with acrylic acid, methacrylic acid or mixtures thereof until the desired residual hydroxyl functionality is reached. Suitable examples include acrylic or the methacrylic esters with linear and branched polyols in which the one or more hydroxyl functionality remains free, such as hydroxyalkylacrylates or hydroxyalkylmethacrylates having 1 to 20 carbon atoms in the alkyl group. Some specific examples include hydroxyethylacrylate (HEA), hydroxyethylmethacrylate (HEMA), hydroxybutylacrylate (HBA), hydroxybutylmethacrylate (HBMA), (3-(acryloxy)-2-hydroxypropylmethacrylate) (AHPMA), glycerol diacrylate, trimethylolpropane diacrylate, pentaerythritoltriacrylate (PETA), ditrimethylolpropane triacrylate (DTPTA), dipentaerythritol pentaacrylate (DPPA), and (poly)ethoxylated and/or (poly)propoxylated equivalents of glycerol diacrylate, trimethylolpropane diacrylate, PETA, DTPTA, or DPPA.

The ink used in the printing systems described herein can also include monomers that can be polymerized by exposure to radicals or other species generated by the first and/or second excimer irradiation source. In some examples, such polymerizable monomers can be used in addition to a polymerizable polyurethane dispersion as described above. In other examples, the ink can include polymerizable monomers without the polymerizable polyurethane dispersions described above.

In some examples, the ink can include polymerizable monomers that are hydrophobic. In certain examples, the polymerizable monomers can be acrylate monomers, vinyl monomers, or combinations thereof. Examples of acrylate monomers can include 2-phenoxyethyl acrylate, isophoryl acrylate, isodecyl acrylate, tridecyl acrylate, lauryl acrylate, 2-(2-ethoxy-ethoxy)ethyl acrylate, tetrahydrofurfuryl acrylate, isobornyl acrylate, propoxylated acrylate, tetrahydrofurfuryl methacrylate, 2-phenoxyethyl methacrylate, isobornyl methacrylate and combinations thereof. Examples of vinyl monomers can include vinyl caprolactam, vinyl ether and any combinations thereof.

In certain examples, the polymerizable monomer can include vinyl caprolactams, hexanediol diacrylates, trimethylolpropane triacrylates, propoxylated neopentyl glycol diacrylates, ethoxylated bisphenol A diacrylate, tris(2-hydroxyethyl) isocyanurate triacrylate, or combinations thereof.

In further examples, the polymerizable monomers can be water-soluble or water-miscible. In some examples, the monomers can include esters of acrylic or methacrylic acid with polyethylene glycol or with a mono-, di-, tri- or tetra-hydric alcohol derived by ethoxylating a mono-, di, tri- or tetra-hydric aliphatic alcohol of molecular weight less than 200 with ethylene oxide. In further examples, the monomers can include acrylate esters of polyethylene glycols made from a polyethylene glycol having a molecular weight of from about 200 to about 1500, or from about 400 to about 800; or acrylic esters of ethoxylated trimethylolpropane, having from 9 to 30 ethoxylate residues, or from 10 to 20 ethoxylate residues. Other examples can include acrylate esters of polyethylene glycols made from a polyethylene glycol having a molecular weight of from about 200 to about 1500 and acrylic esters of ethoxylated trimethylolpropane having from 9 to 30 ethoxylate residues.

Still further examples of the polymerizable monomers can include polyethylene glycol (600) diacrylate, polyethylene glycol (400) diacrylate, methoxy polyethylene glycol (550) mono-acrylate, polyethylene glycol (6) mono-acrylate, 30 ethoxylated bisphenol-A diacrylate, ethoxylated (20) trimethylopropane-triacrylate, (15) ethoxylated trimethylopropane-triacrylate, tris-tryl phenol 18eo acrylate, glycerol 12eo triacrylate, and combinations thereof. In other examples, the monomers can be ethoxylated tri-methylpropane triacrylates.

Examples of suitable commercially available materials can include the following UV-curable materials available from Sartomer such SR415® (ethoxylated (20) trimethylolpropane-triacrylate), CN435® or SR9015®. Other examples of commercially available water-soluble or dispersible monomers include: CD550® (methoxy polyethylene glycol (350) mono-methacrylate), CD552® (methoxy polyethylene glycol (550) mono-methacrylate), SR259® (polyethylene glycol (200) diacrylate), SR344® (polyethylene glycol (400) diacrylate), SR603® (polyethylene glycol (400) dimethacrylate), SR610® (polyethylene glycol (600) diacrylate), SR252® (polyethylene glycol (600) di-methacrylate), SR604® (polypropylene glycol mono-methacrylate, SR256® (2-(2-ethoxyethoxy)ethyl acrylate), SR9035 (ethoxylated(15)trimethylolpropane triacrylate), all available from Sartomer; Ebecryl®11 (polyethylene glycol diacrylate), and Ebecryl®12 (polyether triacrylate) available from UCB; Genomer®1251 (polyethylene glycol 400 diacrylate), Genomer®1343 (ethoxylated trimethylolpropane triacrylate), Genomer® 1348 (glycerol-propoxy triacrylate), Genomer®1456 (polyether polyol tetra-acrylate), and diluent 02-645 (ethoxy ethyl acrylate), all available from Rahn.

In still further examples, the monomers can include acrylamide monomers. Representative and non-limiting examples of acrylamide water-soluble or water-miscible monomers include N-(2-hydroxyethyl) acrylamide; N,N'-methylene bis-acrylamides and/or N-isopropyl acrylamides. Commercially available water-soluble or dispersible monomers include, for examples, Flocryl®MBA available from SNF FLOERGER (France); Jarchem®HEAA or Jarchem®NIPAM both available from Jarchem (USA, N.J.).

In some examples, the ink can further be devoid or substantially devoid of photoinitiators. Because the excimer irradiation source can emit electromagnetic radiation at a wavelength that is adequate to break apart molecular oxygen, the electromagnetic radiation in the presence of oxygen can generate the free radicals necessary for polymerization to occur without the need for a photoinitiator. Eliminating the photoinitiator from the ink can provide advantages such as making the ink more stable, increasing the shelf-life of the ink, and so on. Inks that contain curable components and photoinitiators can often undergo premature polymerization if exposed to UV light. Additionally, many photoinitiators are difficult to disperse or dissolve in aqueous ink vehicles. As such, the present technology allows for the use of curable ink without a photoinitiator. Therefore, these problems can be avoided.

The ink used in the printing systems described herein can also include a liquid vehicle. In some examples, liquid vehicle formulations that can be used in the ink can include water and one or more co-solvents. The co-solvents can be present in total at from 1 wt % to 50 wt %, depending on the jetting architecture. Further, one or more non-ionic, cationic, and/or anionic surfactants can be present, ranging from 0.01 wt % to 20 wt % (if present). In one example, the surfactant can be present in an amount from 0.1 wt % to 20 wt %. The liquid vehicle can also include dispersants in an amount from 0.1 wt % to 20 wt %. The balance of the formulation can be purified water, or other vehicle components such as biocides, viscosity modifiers, materials for pH adjustment, sequestering agents, preservatives, and the like. In one example, the liquid vehicle can be more than 50 wt % water.

In further examples, the liquid vehicle can be a non-aqueous, solvent-based vehicle. In one example, the liquid vehicle can include ethanol and additional co-solvents. Classes of co-solvents that can be used can include organic co-solvents including aliphatic alcohols, aromatic alcohols, diols, glycol ethers, polyglycol ethers, caprolactams, formamides, acetamides, and long chain alcohols. Examples of such compounds include primary aliphatic alcohols, secondary aliphatic alcohols, 1,2-alcohols, 1,3-alcohols, 1,5-alcohols, ethylene glycol alkyl ethers, propylene glycol alkyl ethers, higher homologs ($C_6$-$C_{12}$) of polyethylene glycol alkyl ethers, N-alkyl caprolactams, unsubstituted caprolactams, both substituted and unsubstituted formamides, both substituted and unsubstituted acetamides, and the like. Specific examples of solvents that can be used include, but are not limited to, 2-pyrrolidinone, N-methylpyrrolidone, 2-hydroxyethyl-2-pyrrolidone, 2-methyl-1,3-propanediol, tetraethylene glycol, 1,6-hexanediol, 1,5-hexanediol, and/or 1,5-pentanediol.

Surfactants that can be included in the ink can include alkyl polyethylene oxides, alkyl phenyl polyethylene oxides, polyethylene oxide block copolymers, acetylenic polyethylene oxides, polyethylene oxide (di)esters, polyethylene oxide amines, protonated polyethylene oxide amines, protonated polyethylene oxide amides, dimethicone copolyols, substituted amine oxides, and the like. Suitable surfactants can include, but are not limited to, liponic esters such as Tergitol™ 15-S-12, Tergitol™ 15-S-7 available from Dow Chemical Company, LEG-1 and LEG-7; Triton™ X-100, Triton™ X-405 available from Dow Chemical Company; LEG-1, and sodium dodecylsulfate.

Various other additives may be employed to enhance the properties of the ink composition for specific applications. Examples of these additives are those added to inhibit the growth of harmful microorganisms. These additives may be biocides, fungicides, and other microbial agents, which are routinely used in ink formulations. Examples of suitable microbial agents include, but are not limited to, NUOSEPT® (Nudex, Inc.), UCARCIDE™ (Union carbide Corp.), VANCIDE® (R.T. Vanderbilt Co.), PROXEL® (ICI America), ACTICIDE® (Thor Specialties Inc.) and combinations thereof. Sequestering agents such as EDTA (ethylenediaminetetraaceticacid) may be included to eliminate the deleterious effects of heavy metal impurities. From 0.001% to 2.0% by weight, for example, can be used. Viscosity modifiers may also be present, as well as other additives known to those skilled in the art to modify properties of the ink as desired. Such additives can be present at from 0.01% to 20% by weight.

In some examples, the inkjet ink can include ingredients in the amounts listed in Table 1:

TABLE 1

| Component | Weight Percent |
|---|---|
| Binder | 0.5-10% |
| Biocide | 0-5% |
| Surfactant | 0-10% |
| Anti-kogation agent | 0-5% |
| Colorant | 0.5-10% |
| Organic Co-solvent | 0.1-50% |
| Water* | Balance |

*Note that by "balance," what is meant is that water is used to achieve 100 wt %. Other ingredients other than the ones shown in Table 1 may be present, and water is used to arrive at 100 wt %, regardless of what other ingredients are present.

The media substrate used in the printing system can be any of a wide variety of media substrates. Because the printing system includes the first excimer irradiation source to pre-treat the media substrate before printing, the media substrate may or may not include fixer or other special ingredients to make the media substrate more compatible with inkjet inks. In one example, the media substrate can be substantially devoid of fixer. In another example, the media substrate can include calcium carbonate. Calcium carbonate does not act as a fixer, but the calcium carbonate can be converted into calcium cations by exposure to electromagnetic radiation from the first excimer irradiation source. The treatment with electromagnetic radiation from the first electromagnetic irradiation source can also be used on paper specially manufactured for inkjet printing. The treatment can potentially further improve the print quality using such paper. In various further examples, the media substrate can be plain paper, photo paper, glossy paper, offset paper, coated paper, textile, or combinations thereof.

Figure 4:
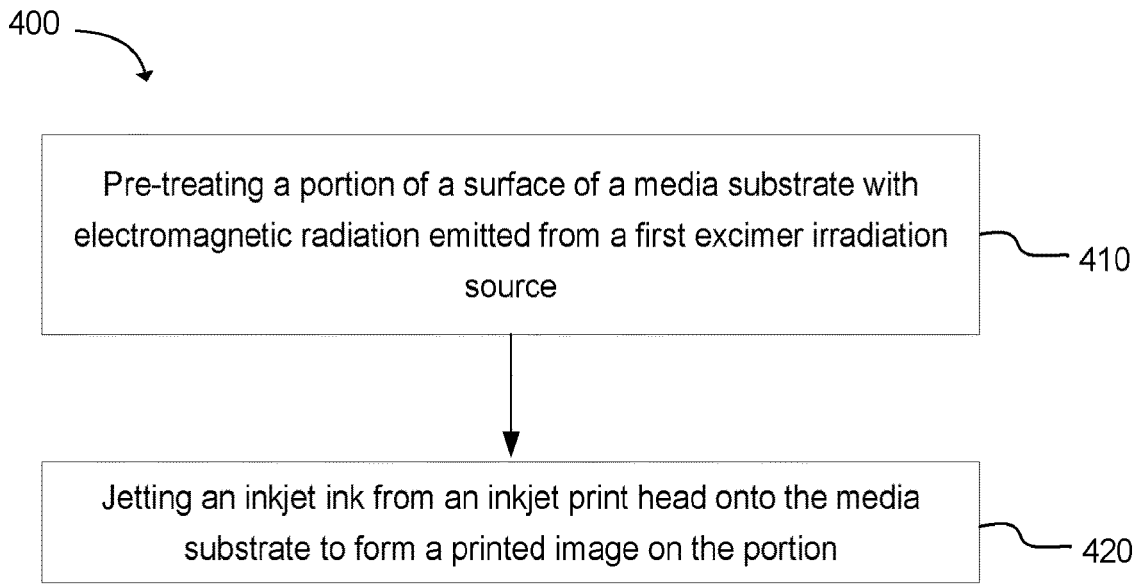
FIG. 4 is a flowchart illustrating an example method of forming a printed image on a media substrate in accordance with examples of the present disclosure.

The present disclosure also includes methods of forming a printed image on a media substrate. FIG. 4 shows one example of a method 400 of forming a printed image on a media substrate. The method includes pre-treating a portion of a surface of the media substrate with electromagnetic radiation emitted from a first excimer irradiation source 410; and jetting an inkjet ink from an inkjet print head onto the media substrate to form a printed image on the portion 420.

In some examples, the method can also include post-treating the printed image with electromagnetic radiation emitted from a second excimer irradiation source, as described above. Where this is the case, in some specific examples, the first excimer irradiation source can emit electromagnetic radiation at a different wavelength than the second excimer irradiation source.

In further examples, the pre-treatment, post-treatment, or both can be performed for a time period of 0.1 second to 60 seconds. In more specific examples, the time period can be 0.2 second to 45 seconds or 0.5 second to 30 seconds. As used herein, the time period of the treatment with electromagnetic radiation from an excimer irradiation source refers to the amount of time that a treated portion of the media substrate is exposed to the electromagnetic radiation. In the case of a web-fed printing system, the media substrate can constantly move past the excimer irradiation source. Thus, the time period of the treatment can be the time required for a point on the media substrate to travel across the length of the excimer irradiation source. In examples where the printing system includes the excimer irradiation source on a carriage, the excimer irradiation source can either be held stationary over a portion of the media substrate for the pre-treatment and/or post-treatment time period, or the carriage can move at an appropriate speed so that each portion of the media substrate is pre-treated and/or post treated for the appropriate time period.

Generally, longer pre-treatment time periods can provide better printing results, as signified by higher optical density and color saturation. However, in some examples a maximum effect can be reached after a certain time period. This time period can be from 0.1 second to 60 seconds or any of the other time periods described above. In further examples, the distance of the first excimer irradiation source from the media substrate can affect the time period required to reach the maximum pre-treatment effect. At greater distances, a longer time period may be required.

Additionally, longer post-treatment periods can provide better durability of curable ink. In further examples, the distance of the second excimer irradiation source from the media substrate can affect the time period required to reach a given level of durability. At greater distances, a longer time period may be required.

Figure 5:
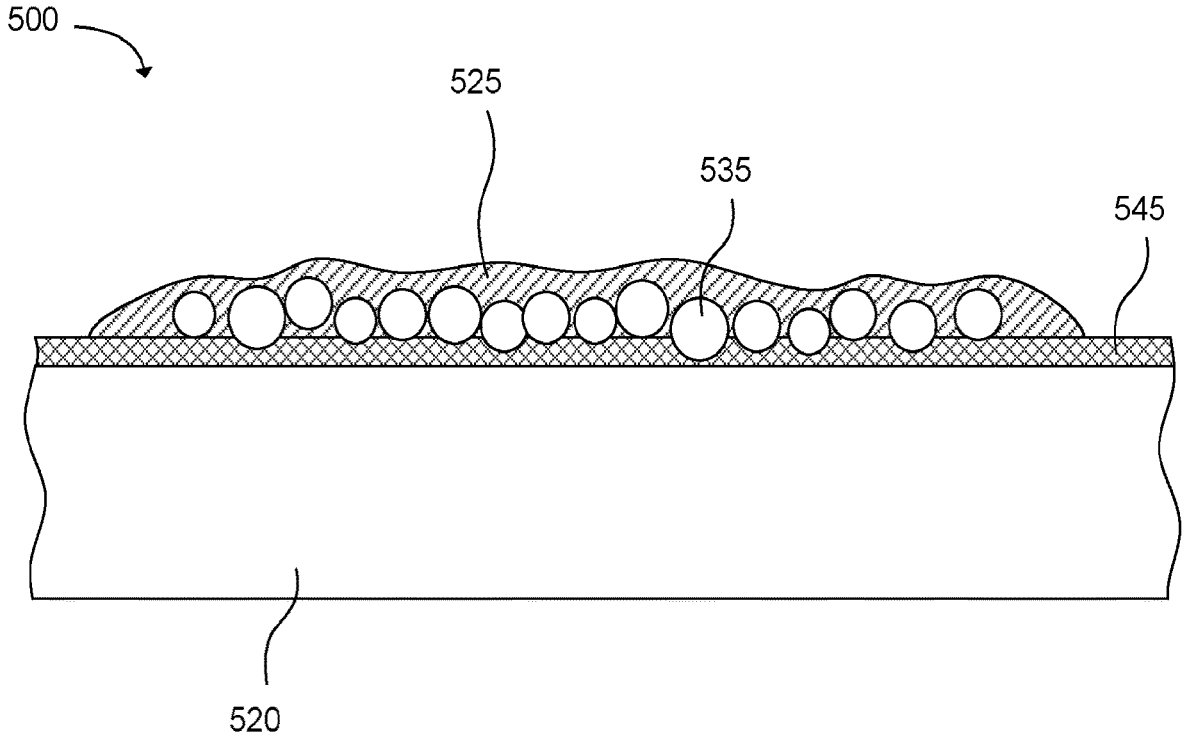
FIG. 5 is a schematic cross-sectional side view of an example printed article in accordance with examples of the present disclosure.

The present disclosure also includes printed articles made using the systems and methods described herein. FIG. 5 shows one example of a printed article 500. The printed article includes a media substrate 520. The media substrate includes a surface 545 that has been modified by exposure to electromagnetic radiation emitted from a first excimer irradiation source before printing to form cationic species, acid groups, oxygen containing groups, or a combination thereof on the surface. The media substrate can be devoid of or substantially devoid of a printed fixer. A digitally printed image is formed on the modified surface of the media substrate such that pigment particles 535 in the digitally printed image are in contact with the modified surface of the media substrate. In some examples, the printed image can include an inkjet ink that has been cured by exposure to electromagnetic radiation emitted from a second excimer irradiation source. For example, the printed image can include pigment particles in contact with the surface of the media substrate and a cured binder 525 disposed over and throughout the pigment particles.

It is noted that, as used in this specification and the appended claims, the singular forms "a," "an," and "the" include plural referents unless the content clearly dictates otherwise.

As used herein, the term "about" is used to provide flexibility to a numerical range endpoint by providing that a given value may be "a little above" or "a little below" the endpoint. The degree of flexibility of this term can be dictated by the particular variable and can be determined based on experience and the associated description herein.

In this disclosure, "comprises," "comprising," "having," "includes," "including," and the like, and are generally interpreted to be open ended terms. The term "consisting of" is a closed term, and includes only the methods, compositions, components, steps, or the like specifically listed. "Consisting essentially of" or "consists essentially" or the like, when applied to methods, compositions, components, steps, or the like encompassed by the present disclosure, refers to elements like those disclosed herein, but which may contain additional composition components, method steps, etc., that do not materially affect the basic and novel characteristic(s) of the compositions, methods, etc., compared to those of the corresponding compositions, methods, etc., disclosed herein. When using an open ended term, like "comprising" or "including," it is understood that direct support should be afforded also to "consisting essentially of" language as well as "consisting of" language as if stated explicitly, and vice versa.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of 1 wt % and about 20 wt %, but also to include individual weights such as 2 wt %, 11 wt %, 14 wt %, and sub-ranges such as 10 wt % to 20 wt %, 5 wt % to 15 wt %, etc.

Percentages, ratios, and parts refer to weight percentages, weight ratios, and parts by weight unless otherwise specified or otherwise clear from the surrounding context.

As a further note, in the present disclosure, it is noted that when discussing the printing systems, methods of forming a printed image, and printed articles, each of these discussions can be considered applicable to each of these examples, whether or not they are explicitly discussed in the context of that example. Thus, for example, in discussing details about the printing system per se, such discussion also refers to the methods and the printed articles described herein, and vice versa.

The following examples illustrate aspects of the present technology. However, it is to be understood that these examples are only exemplary or illustrative of the application of the principles of the present systems and methods. Numerous modifications and alternative systems, methods, compositions, media, and so on may be used without departing from the spirit and scope of the present disclosure. The appended claims are intended to cover such modifications and arrangements. Thus, while the technology has been described with particularity, the following examples provide further detail in connection with the present technology.

EXAMPLES

Example 1—Pre-Treatment of Print Media with an Excimer Irradiation Source

The excimer irradiation source used in this study was an excimer lamp having a surface power density of 60 mW/cm$^2$ at the lamp surface. This particular lamp emitted electromagnetic radiation at a wavelength of about 174 nm. Various samples of non-ColorLok® paper were positioned at a distance of about 2 mm below a quartz window of the excimer lamp housing and exposed to electromagnetic radiation from the excimer lamp for different periods of time to determine the effect on color saturation and optical density.

It was observed that the areas exposed to excimer lamp radiation exhibited improved color saturation as compared to areas of the print media that were not exposed to the excimer lamp. Table 2 below provides color saturation values for cyan and magenta inks on print media that was pre-treated with electromagnetic radiation from an excimer lamp for various time periods.

TABLE 2

| | 0 seconds | 1 second | 5 seconds | 15 seconds | 30 seconds |
|---|---|---|---|---|---|
| Cyan | 0.71 | 0.72 | 0.76 | 0.81 | 0.82 |
| Magenta | 0.94 | 0.97 | 1.02 | 1.15 | 1.16 |

As can be seen in Table 2, pre-treatment of the print media with electromagnetic radiation from an excimer lamp prior to printing increased color saturation for both cyan and magenta inks at all treatment times.

Black optical density (KOD) measurements were also obtained for pre-treated print media under the same conditions as described above. These results are presented in Table 3 below.

TABLE 3

| | 0 seconds | 1 second | 5 seconds | 15 seconds | 30 seconds |
|---|---|---|---|---|---|
| KOD | 1.19 | 1.00 | 1.05 | 1.28 | 1.31 |

In contrast to the color saturation results, the KOD values do not exhibit continuous improvement of quality with increasing exposure times. Rather, there was a decrease in KOD values at exposure times of 1 second and 5 seconds and an improvement in KOD values at exposure times of 15 seconds and 30 seconds.

Example 2—Post-Treatment of Print Media with an Excimer Irradiation Source

The same excimer lamp as described in Example 1 was also employed in this example. The print media were printed with an ink containing a curable component. The printed area was allowed to dry prior to exposure to the excimer lamp. No photoinitiator was used in the ink because the electromagnetic radiation from the excimer lamp interacting with air was sufficient to generate the free radicals necessary for polymerization to occur. A portion of the printed area was exposed to electromagnetic radiation from the excimer lamp for a period of 15 seconds.

An abrasive wipe was then wetted and passed across the surface of the treated and untreated portions of the printed area. The untreated area had very poor smudging properties. In contrast, there was no visible smudging of the treated area. As such, post-treatment with the excimer lamp was adequate to cure a curable ink, even without a photoinitiator.

While the disclosure has been described with reference to certain examples, various modifications, changes, omissions, and substitutions can be made without departing from the spirit of the disclosure. It is intended, therefore, that the disclosure be limited only by the scope of the following claims.

What is claimed is:

1. A printing system, comprising:

a first excimer irradiation source positioned to irradiate a media substrate, wherein the first excimer irradiation source has power metrics and is posited at a distance from the media substrate to provide electromagnetic radiation at the surface of the media substrate at a surface power density of from 20 mW/cm$^2$ to 80 mW/cm$^2$ and an inkjet print head positioned with respect to the excimer irradiation source to form a printed image on the media substrate after irradiation with the excimer irradiation source.

2. The printing system of claim 1, further comprising a second excimer irradiation source positioned to treat the printed image after application to the media substrate.

3. The printing system of claim 2, wherein the first excimer irradiation source, the second excimer irradiation source, or both have a width that is 75% or more as wide as the print media.

4. The printing system of claim 2, wherein the first excimer irradiation source, the second excimer irradiation source, or both are positioned at a distance from 0.5 millimeters (mm) to 5 mm from the media substrate.

5. The printing system of claim 2, wherein the first excimer irradiation source, the second excimer irradiation source, or both emit electromagnetic radiation at a wavelength ranging from 108 nm to 222 nm.

6. The printing system of claim 1, wherein the first excimer irradiation source and the inkjet printhead are attached to a carriage to pass the first excimer irradiation source over a portion of the media substrate to pretreat the media substrate prior to passing the inkjet printhead over the media substrate to form the printed image on the portion of the media substrate.

7. The printing system of claim 1, further comprising an ink reservoir in fluid communication with the inkjet print head, the ink reservoir comprising a pigment-based inkjet ink, wherein the pigment-based inkjet ink comprises an anionic pigment material.

8. A method of forming a printed image on a media substrate, comprising:

pre-treating a portion of a surface of a media substrate with electromagnetic radiation emitted from a first excimer irradiation source, wherein the first excimer irradiation source has power metrics and is posited at a distance from the media substrate to provide electromagnetic radiation at the surface of the media substrate at a surface power density of from 20 MW/cm$^2$ to 80 mW/cm$^2$; and jetting an inkjet ink from an inkjet print ad onto the media substrate to form a printed image on the portion.

9. The method of claim 8, further comprising post-treating the printed image with electromagnetic radiation emitted from a second excimer irradiation source.

10. The method of claim 9, wherein the first excimer irradiation source emits electromagnetic radiation at a different wavelength than the second excimer irradiation source.

11. The method of claim 9, wherein pre-treating, post-treating, or both is performed for a time period ranging from 0.1 second to 60 seconds.

12. A system for a printed article, the printed article comprising:

a media substrate having a modified surface formed by exposure to electromagnetic radiation emitted from a first excimer irradiation source to form cationic species, acid groups, oxygen containing groups, or a combination thereof on the surface, wherein the media substrate is substantially devoid of printed fixer, wherein the first excimer irradiation source has power metrics and is posited at a distance from the media substrate to provide electromagnetic radiation at the surface of the media substrate at a surface power density of from 20 mW/cm$^2$ to 80 mW/cm$^2$; and a digitally printed image on the modified surface, including pigment particles in contact with the modified surface of the media substrate.

13. The system for a printed article of claim 12, wherein the media substrate is a polyolefin media substrate, a plain paper media substrate, or a coated offset media substrate.

14. The system for a printed article of claim 12, wherein the digitally printed image is formed with a curable inkjet ink that has been cured by exposure to electromagnetic radiation emitted from a second excimer irradiation source, and wherein the curable inkjet ink is devoid of a photoinitiator.

* * * * *